US006186419B1

(12) United States Patent
Kampmann et al.

(10) Patent No.: US 6,186,419 B1
(45) Date of Patent: Feb. 13, 2001

(54) FUEL INJECTION DEVICE

(75) Inventors: Stefan Kampmann, Bamberg; Bernd Dittus, Tamm, both of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/242,708

(22) PCT Filed: Apr. 25, 1998

(86) PCT No.: PCT/DE98/01159

§ 371 Date: Feb. 24, 1999

§ 102(e) Date: Feb. 24, 1999

(87) PCT Pub. No.: WO98/59168

PCT Pub. Date: Dec. 30, 1998

(30) Foreign Application Priority Data

Jun. 24, 1997 (DE) ..... 197 26 727

(51) Int. Cl.[7] ..... F02M 39/00

(52) U.S. Cl. ..... 239/533.3; 239/533.12; 239/504; 251/129.21

(58) Field of Search ..... 239/533.2, 533.12, 239/533.3, 499, 502, 504, 513; 251/129.21, 129.15

(56) References Cited

U.S. PATENT DOCUMENTS 4,177,948 * 12/1979 Schaffitz et al. ..... 239/533.12
5,343,699 9/1994 McAlister .
5,348,232 9/1994 Babitzka et al. .

FOREIGN PATENT DOCUMENTS 41 42 430 7/1992 (DE) .
43 03 813 6/1994 (DE) .
195 23 165 1/1996 (DE) .
0 363 162 4/1990 (EP) .
2 240 137 7/1991 (GB) .

* cited by examiner

*Primary Examiner*—Andres Kashnikow
*Assistant Examiner*—Lisa Ann Douglas
(74) *Attorney, Agent, or Firm*—Kenyon & Kenyon

(57) ABSTRACT

A fuel injection nozzle or fuel injector valve has a nozzle body, extending along a longitudinal axis, on which is configured a valve seat surface which coacts with a valve closure surface configured on a valve closure element to form a valve seat. At least one fuel stream, which has a radial directional component with respect to the longitudinal axis of the nozzle body, is sprayed out when the fuel injection valve or fuel injector nozzle is in an open state. A sleeve body axially overlaps the fuel stream in the direction of the longitudinal axis. The sleeve body has at least one impact surface which the fuel stream strikes. The impact surface is inclined at a predefined angle with respect to a vertical plane which runs vertically with respect to the longitudinal axis, and/or the impact surface is structured in fluted fashion on its surface.

19 Claims, 4 Drawing Sheets

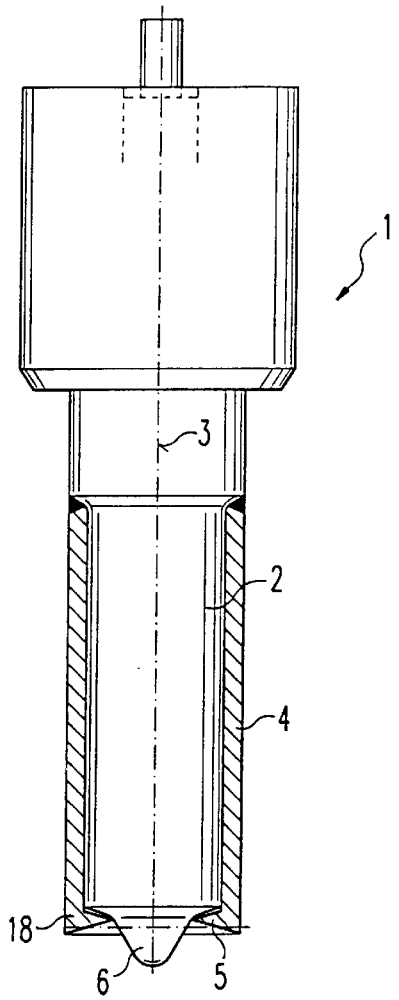
Fig. 1
Fig. 2
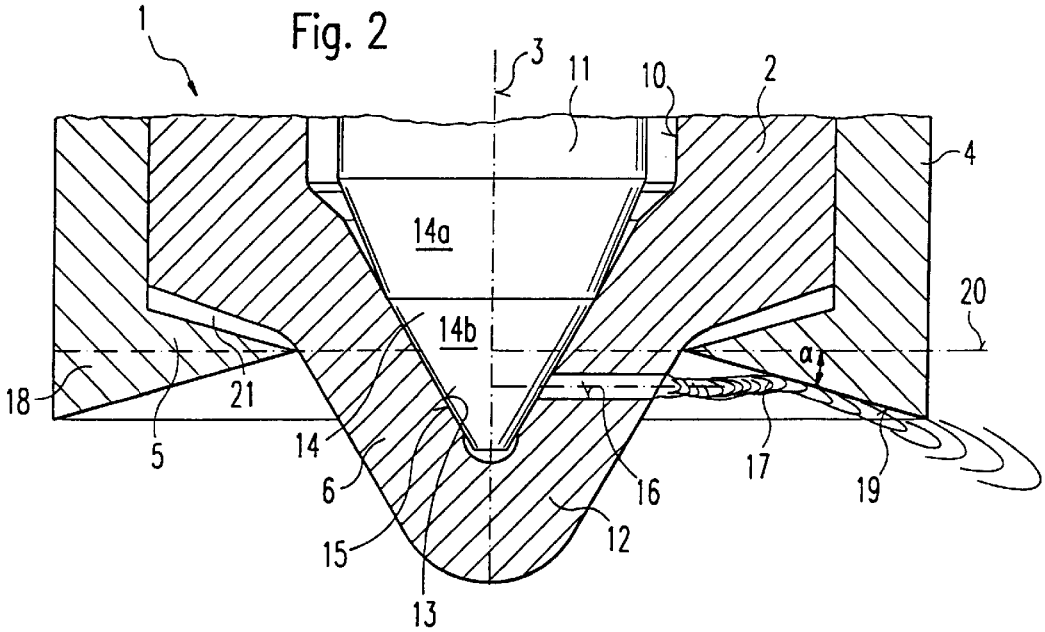

FUEL INJECTION DEVICE

FIELD OF THE INVENTION

The present invention relates to a fuel injection valve and to a fuel injector nozzle, in particular for direct injection of fuel into the combustion chamber of an internal combustion engine.

BACKGROUND INFORMATION

A conventional fuel injector nozzle is described in, e.g., German Patent No. 43 03 813. This conventional fuel injector nozzle includes a nozzle body having a blind bore in which a valve needle, which has at its downstream end a valve closure element, is axially movable. The valve closure element is of conical configuration and has a valve closure surface which coacts with a valve seat surface provided internally on the nozzle body to form a valve seat. The valve needle is preloaded in the closing direction by a return spring. At its spray-discharge end, the nozzle body has several radial bores, arranged in circumferentially distributed fashion, which penetrate through the nozzle body and, when the fuel injector nozzle is in the open position, are connected to the blind bore of the nozzle body. With the fuel injection valve in the closed position, however, inflow of fuel from the blind bore to the radial bores is interrupted.

A fuel injector nozzle of similar design, but with several pairs of radial bores which open into a common outlet opening at different spray angles, is described in German Patent Application No. 41 42 430.

In these conventional fuel injector nozzles, it is disadvantageous that axial and radial fuel distribution cannot be adapted to the geometrical conditions of the internal combustion engine on which the fuel injector nozzles are mounted. Since, however, the positions of the spark plug, the intake and exhaust valves, and other components in and on the combustion chambers of the internal combustion engine can vary considerably from one internal combustion engine to another or from one vehicle model to another, flexibility in the use of the known fuel injector nozzles is limited. The provision in each case of a pair of radial bores with different spray angles, as described in German Patent Application No. 41 42 430, moreover requires a relatively high production outlay.

SUMMARY OF THE INVENTION

The fuel injection valve or fuel injector nozzle according to the present invention, has the advantage that the sprayed fuel is distributed in directed fashion, and that distribution of the fuel can easily be varied by varying the geometrical configuration of the sleeve body. For example, the angle of inclination of the impact surface at which the fuel strikes the sleeve body, as well as the surface structuring of the impact surface (for example with radial flutes), have a substantial influence on fuel distribution. The impact surface can be inclined with respect to the vertical plane of the longitudinal axis of the fuel injection valve or the fuel injector nozzle in both the radial and the tangential direction. Together with surface structuring, several degrees of freedom therefore result for fuel stream forming. One variation in fuel distribution can be economically achieved in that a differently shaped sleeve body is used for each application. While the usual components of the fuel injection valve or fuel injector nozzle can be uniformly produced for all applications with no individual modifications, only a differently shaped sleeve body is used in each case. Production costs can thereby be considerably reduced.

It is advantageous if the impact surface of the sleeve body has on its radially external end an at least partially circumferential detachment edge which is undercut, by an at least partially circumferential groove in the sleeve body, in such a way that the contour of the sleeve body forms an acute angle at the detachment edge. A good turbulence in the fuel-air mixture is thereby obtained. A recirculation zone is created in the region of the groove. It is possible to arrange ignition electrodes in this region, since in this region the concentration of the fuel-air mixture lies within ignition limits. If the ignition electrodes are arranged so that they extend axially only as far as the circumferential groove of the sleeve body, this ensures that the ignition electrodes are not directly wetted by the fuel stream, which would be disadvantageous. The ignition electrodes lie, to a certain extent, in the shadow of the detachment edge. With this combination of the fuel injection valve or fuel injector nozzle with a spark plug, it is advantageous to configure the sleeve body from a preferably ceramic insulating material.

The sleeve body can also be subdivided into several sectors spaced apart by recesses, at least one impact surface for a fuel stream being provided in each sector. The nozzle body preferably has several circumferentially distributed radial bores, through each of which a separate fuel stream emerges and strikes an associated sector of the sleeve body. The impact surfaces can also be inclined in a tangential direction with respect to the vertical plane of the longitudinal axis.

The impact surface of the sleeve body or the impact surface of each sector of the sleeve body can have a surface structuring, preferably in the form of flutes running in a radial direction.

The fuel injection valve or fuel injection nozzle can have either an inward-opening or an outward-opening valve closure element. When an outward-opening valve closure element is used, it is advantageous if the sleeve body projects beyond the spray-discharge end of the nozzle body that forms the valve seat surface by an axial longitudinal distance which is smaller than the maximum opening stroke of the valve closure element. The result is that when the opening stroke of the valve closure element is short, the fuel stream strikes the impact surface of the sleeve body and is deflected in the axial direction. If the opening stroke of the valve closure element is relatively long, on the other hand, a portion of the fuel stream does not strike the impact surface of the sleeve body, but rather is sprayed out in a radial direction. This variation in the effective spray discharge direction as a function of the opening stroke is very advantageous for certain applications for fuel injection valves or fuel injector nozzles which inject directly into the combustion chamber of the internal combustion engine.

BRIEF DESCRIPTION OF THE DRAWINGS

FIG. 1 shows a partially sectioned view of a first exemplary embodiment of a fuel injector nozzle according to the present invention.

FIG. 2 shows a section through a spray-discharge end of the fuel injector nozzle illustrated in FIG. 1.

DETAILED DESCRIPTION

Figure 3:
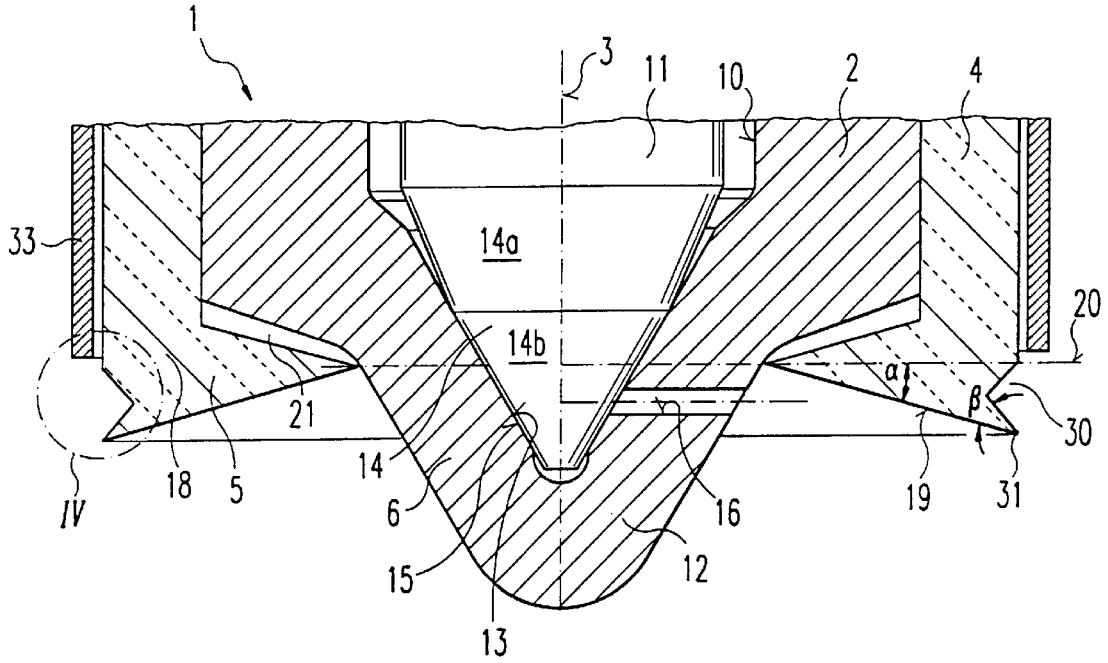
FIG. 3 shows a partially sectioned view of a second exemplary embodiment of the fuel injector nozzle according to the present invention.

FIG. 1 shows a fuel injector nozzle 1 according to the present invention in a partially sectioned depiction. Fuel injector nozzle 1 is suitable for direct injection of fuel, for example diesel fuel, into the combustion chamber of an internal combustion engine, for example a compression-ignited internal combustion engine. The embodiment according to the present invention is also suitable however, for fuel injection valves which also preferably inject directly into the combustion chamber of the internal combustion engine, e.g. for direct fuel injection in spark-ignited internal combustion engines. Fuel injector nozzle 1 has a nozzle body 2, insertable into an assembly bore of a cylinder head of an internal combustion engine, which extends along a longitudinal axis 3 of fuel injector nozzle 1. Nozzle body 2 is surrounded by a sleeve body that is depicted in section in FIG. 1. Sleeve body 4 has at its spray-discharge end 18 an inwardly protruding projection 5, triangular in cross-sectional profile, which annularly encompasses a spray-discharge end section 6 of fuel injector nozzle 1.

The spray-discharge end region of fuel injector nozzle 1 according to the present invention is depicted at enlarged scale in FIG. 2 in a sectioned depiction. Nozzle body 2 has a blind bore 10, extending along longitudinal axis 3, which receives a valve needle 11. At its spray-discharge end section 6, the nozzle body has a rounded protrusion 12 which is substantially V-shaped in cross-sectional profile. Protrusion 12 has on its inner side a valve seat surface 13 which coacts with a valve closure surface 15 provided on a valve closure element 14 to form a valve seat. In the exemplary embodiment shown in FIG. 2, valve closure element 14, for example configured integrally with valve needle 11, has a two-stage conical configuration with an upstream conical section 14*a* and a downstream conical section 14*b*, valve closure surface 15 being the enveloping surface of downstream conical section 14*b*.

Provided in protrusion 12 is at least one radial bore 16, but preferably several radial bores 16, arranged in circumferentially distributed fashion, which extend outward radially with respect to longitudinal axis 3 but at least with a radial component with respect to longitudinal axis 3, and which open into blind bore 10 either in the region of valve seat surface 13 or downstream from valve seat surface 13. With fuel injector nozzle 1 in the closed state, radial bores 16 are closed off by valve closure element 14; while with fuel injector nozzle 1 in the open state, valve closure element 14 lifts away from valve seat surface 13 and thus allows fuel to flow from blind bore 10 into radial bores 16. Several fuel streams 17, which are sprayed out in different radial directions, are thereby generated. In the sectioned depiction of FIG. 2, only one fuel stream 17 and one radial bore 16 are depicted.

According to the present invention, nozzle body 2 is surrounded by sleeve body 4, which preferably is made of stainless steel or a ceramic material. Downstream end 18 of sleeve body 4 extends into the region of fuel streams 17 sprayed out from radial bores 16. In other words, fuel streams 17 are overlapped in the axial direction by sleeve body 4. Sleeve body 4 has an impact surface 19 which all the fuel streams 17 strike. In the example depicted in FIG. 2, impact surface 19 is inclined in the radial direction with respect to a plane, referred to here as vertical plane 20, running perpendicular to longitudinal axis 3 and horizontally in FIG. 2, and forms a frustoconical end surface of sleeve body 4. Instead of being inclined in the radial direction, however, impact surface 19 could also be inclined in the tangential direction with respect to vertical plane 20, which will be described later with reference to the exemplary embodiment depicted in FIG. 5. The angle of inclination $\alpha$ which impact surface 19 assumes with respect to vertical plane 20 of longitudinal axis 3 is preferably a flat angle of between 0° and 45°. The range for angle of inclination a preferably lies between 5° and 30°, and a preferable single being approximately 15°.

The impact of fuel streams 17 onto impact surface 19 of sleeve body 4 imparts a good turbulence to fuel streams 17, and thus results in the generation of small-diameter fuel particles. Thorough air-fuel mixing is also promoted. A further improvement of these effects can be achieved by the fact that impact surface 19 has a predefined surface roughness.

An air gap 21, which effects thermal insulation between spray-discharge end 18 of sleeve body 4 and nozzle body 2, is provided between nozzle body 2 and the inwardly protruding projection 5 of sleeve body 4.

FIG. 3 illustrates a second exemplary embodiment of an injector nozzle according to the present invention, in a sectioned partial depiction. Elements already described are given matching reference characters, so that descriptions do not need to be repeated. The exemplary embodiment depicted in FIG. 3 refers to an application in a spark-ignited internal combustion engine. In the exemplary embodiment depicted in FIG. 3, a spark plug is combined with injector nozzle 1 or with a fuel injection valve.

In contrast to the exemplary embodiment described above with references to FIGS. 1 and 2, sleeve body 4 has a circumferential groove 30 that is V-shaped in cross section. Impact surface 19 is delimited radially outward by a detachment edge 31. The contour of sleeve body 4 forms an acute edge angle $\beta$ at detachment edge 31, edge angle $\beta$ being further decreased by the V-shaped groove 30.

Figure 4:
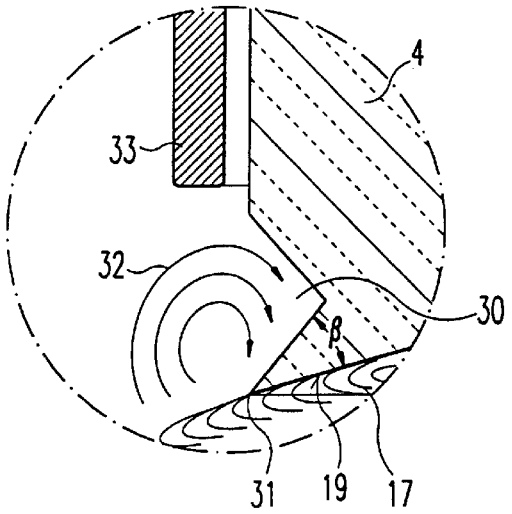
FIG. 4 shows an enlarged area IV illustrated in FIG. 3.

FIG. 4 shows area IV in FIG. 3 in an enlarged depiction. To illustrate the effect of detachment edge 31, fuel stream 17 is also drawn in. As illustrated in FIG. 4 by arrows 32, there occurs in the region of groove 30 a recirculation zone in which the fuel-air mixture flows toward an ignition electrode 33. In a preferred exemplary embodiment, several ignition electrodes are provided, which are arranged in circumferential distribution around sleeve body 4 and are electrically insulated from one another by a recess or by an insulator. Respective adjacent ignition electrodes 33 carry different polarities of a high-voltage source, spark discharge being generated at the downstream end of ignition electrodes 33. Ignition electrodes 33 extend into the region of circumferential groove 30, or end slightly upstream from groove 30. As a result of detachment edge 31, a highly turbulent air-fuel mixture, which lies within ignition limits and can therefore easily be ignited by a spark jumping between ignition electrodes 33, is created in the recirculation zone. Fuel stream 17 does not, however, strike ignition electrodes 33 directly, thus avoiding any disadvantageous wetting of ignition electrodes 33 with fuel.

According to this exemplary embodiment, it is advantageous to configure sleeve body 4 from an electrically insulating material, in particular from a suitable ceramic material, in order to ensure insulation of ignition electrodes 33 with respect to nozzle body 2. Instead of several ignition electrodes, it is also optionally possible to use a single ignition electrode 33, the ignition spark jumping to a suitable counterelement, carrying the opposite potential, on nozzle body 2. Alternatively, the recirculation zone marked with arrows 32 can also be utilized to ignite the fuel-air mixture by way of a separate spark plug that is not combined with fuel injector nozzle 1 or with the fuel injection valve. The configuration of a sharp detachment edge 31 also has considerable advantages in the case of compression-ignited internal combustion engines because of the favorable turbulence imparted to the fuel-air mixture.

Figure 5:
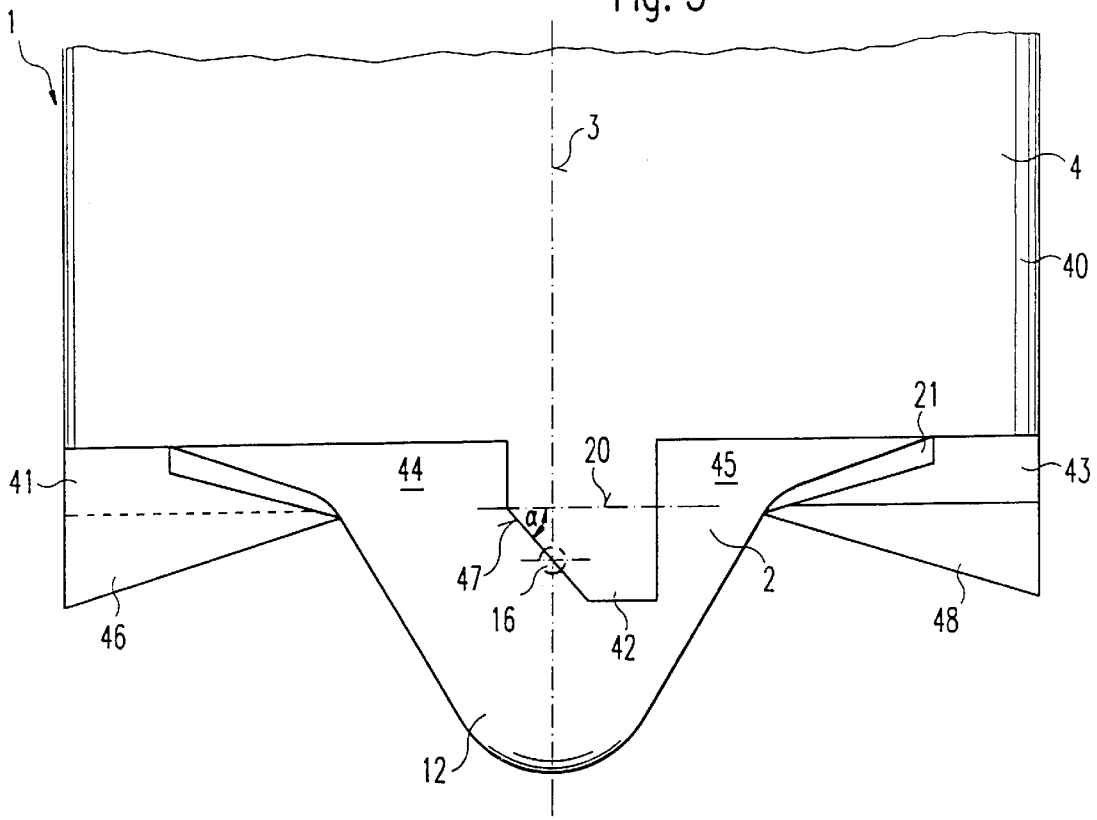
FIG. 5 shows a partial view of a third exemplary embodiment of the fuel injector nozzle according to the present invention.

FIG. 5 shows a third exemplary embodiment of a fuel injector nozzle 1 according to the present invention. In FIG. 5, elements already described are given matching reference characters, so that descriptions do not need to be repeated.

In FIG. 5, nozzle body 2 is not shown sectioned. Protrusion 12 at the spray discharge end, with a radial bore 16 penetrating through protrusion 12, is illustrated. In the exemplary embodiment depicted in FIG. 5, a total of four radial bores 16 are provided, each offset 90° from one another. Associated with each radial bore 16 is a sector 41 through 43 shaped onto main body 40 of sleeve body 4. The individual sectors 41 through 43 are separated from one another by recesses 44, 45. Provided on each sector 41 through 43 is an impact surface 46 through 48 which is inclined tangentially with respect to vertical plane 20 of longitudinal axis 3 by an angle of inclination $\alpha$. Additionally or alternatively, a radial inclination of impact surfaces 46 through 48 can also be provided.

The fuel streams (not shown in FIG. 5) are reflected or dispersed at impact surfaces 46 through 48 of the associated sectors 41 through 43, resulting in a suitable fanning out of the fuel streams as well as better turbulence in the fuel-air mixture. The geometrical configuration of the individual sectors 41 through 43 can be adapted to the geometrical configuration of the combustion chamber of the internal combustion engine on which fuel injector nozzle is being used. In particular, the angle of inclination $\alpha$ of each impact surface 46 through 48 can be selected to be different, depending on whether the spark plug or intake and exhaust valves—wetting of which with fuel is to be avoided if at all possible—are arranged in the corresponding region of the internal combustion engine. The emissions level of the internal combustion engine can be substantially improved in this fashion. In addition, flexible utilization of fuel injector nozzles 1 according to the present invention, or the injection valves according to the present invention, can be achieved in that different sleeve bodies 4 are used depending on the application, i.e. depending on the type of internal combustion engine or the vehicle model. It is advantageous in this context that the other components of fuel injector nozzle 1 or of the fuel injection valve can remain unchanged.

Figure 6:
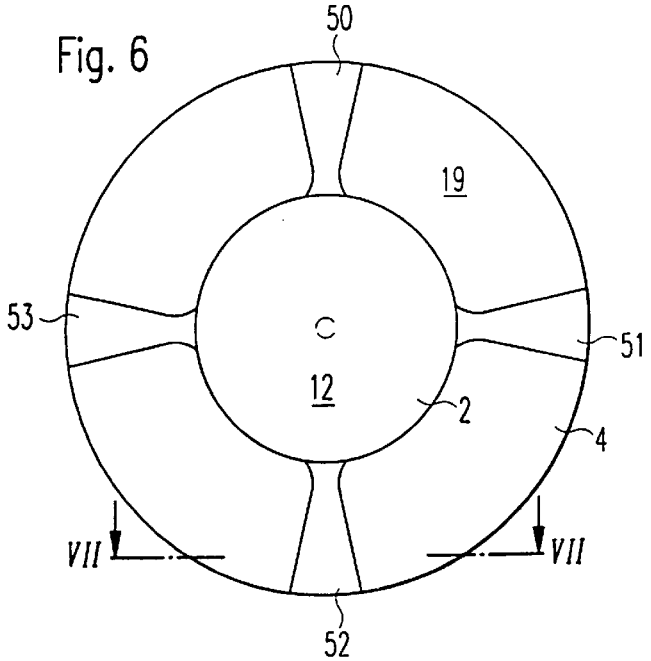
FIG. 6 shows a view from the spray discharge end of a fourth exemplary embodiment of the fuel injector nozzle according to the present invention.
Figure 7:
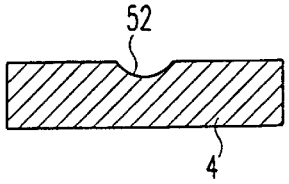
FIG. 7 shows a section along line VII—VII illustrated in FIG. 6.

FIGS. 6 and 7 show a fourth exemplary embodiment of a fuel injector nozzle 1 according to the present invention. FIG. 6 shows a view of the spray-discharge end of fuel injector nozzle. Protrusion 12 of nozzle body 2 at the spray discharge end, and sleeve body 4 surrounding nozzle body 2, are visible. The special aspect of the exemplary embodiment depicted in FIGS. 6 and 7 is that impact surface 19 of sleeve body 4 has a fluted surface structure. A radially extending flute 50 through 53 is provided for each fuel stream. In the exemplary embodiment depicted, flutes 50 through 53 initially taper in their radial course from inside to outside, while they then expand out to their mouths in the manner of a diffusor. Flutes 50 through 53 serve to improve the guidance of fuel streams 17, and can of course also be configured in other suitable ways. It is additionally possible to incline impact surface 19 in a radial and/or tangential direction with respect to vertical plane 20 of longitudinal axis 3, in accordance with the exemplary embodiments described above.

FIG. 7 shows a section along line VII—VII in FIG. 6, the depression of flute 52 being clearly indicated.

Figure 8:
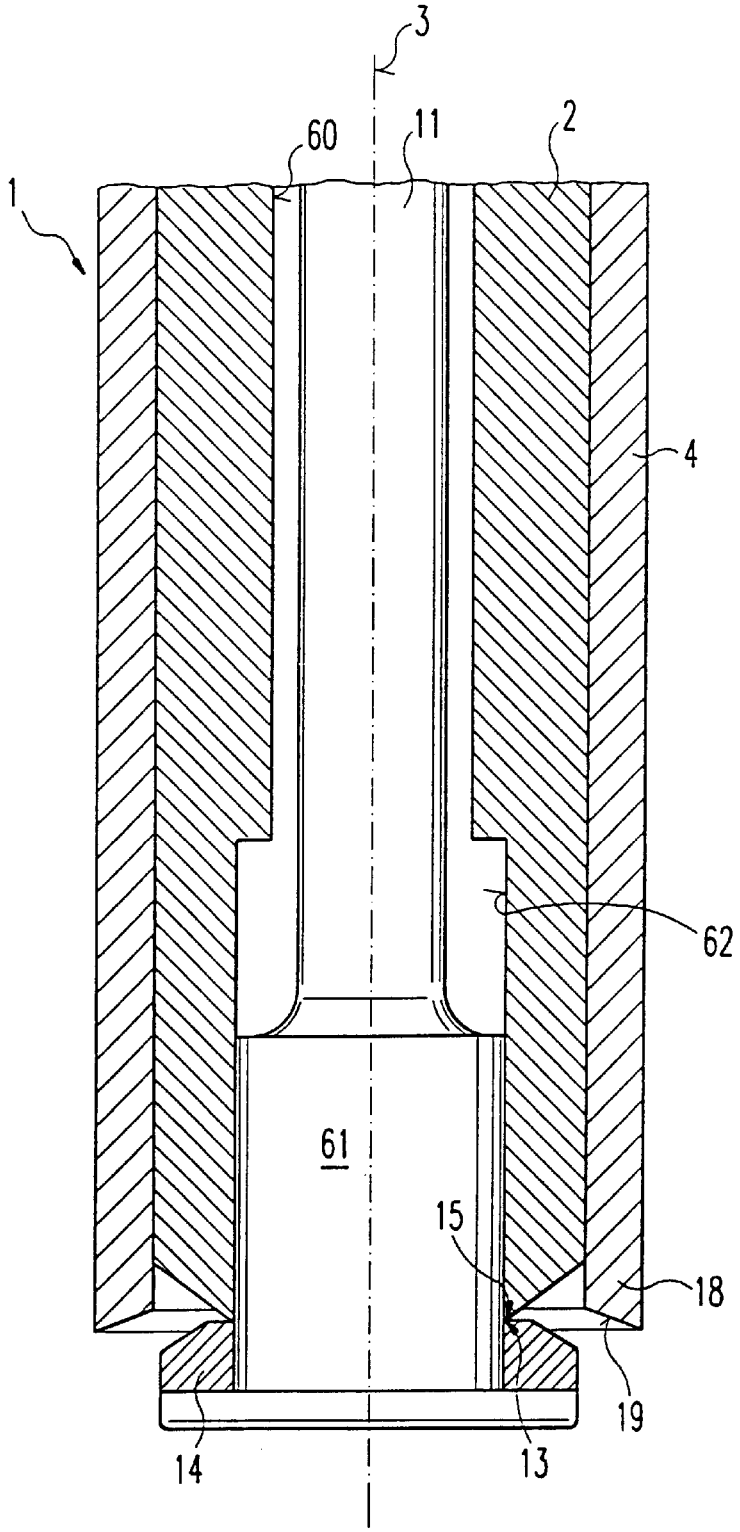
FIG. 8 shows a section through the spray-discharge end of a fifth exemplary embodiment of the fuel injector nozzle according to the present invention.

FIG. 8 shows a fifth exemplary embodiment of a fuel injector nozzle 1 according to the present invention. Elements already described above given matching reference characters, so that descriptions do not need to be repeated.

While the exemplary embodiments described above concern an inward-opening fuel injector nozzle 1, fuel injector nozzle 1 depicted in FIG. 8 has an outward-opening valve closure element 14. Nozzle body 2 has, in this context, a through bore 60 configured as a stepped bore, in which a valve needle 11 is arranged. At its spray-discharge end, valve needle 11 has a guide section 61 which is guided in an expanded-diameter stage 62 of through bore 60. Annular valve closure element 14, whose valve closure surface 15 coacts with valve seat surface 13 of nozzle body 2 to form a valve seat is shaped externally in guide section 61. When the opening stroke of valve closure element 14 is short, the entirety of the fuel stream sprayed out by fuel injector nozzle 1 strikes impact surface 19 of sleeve body 4, and is reflected by impact surface 19 in an axial direction, i.e. in the direction of longitudinal axis 3. As the opening stroke of valve closure element 14 increases, the fuel stream is widened in the direction of longitudinal axis 3, and beyond a predefined opening stroke of valve closure element 14 no longer entirely strikes impact surface 19. One partial stream is therefore sprayed out in the radial direction, while another partial stream is reflected, as described above, from impact surface 19 of sleeve body 4 in the direction of longitudinal axis 3.

The above-described spray discharge behavior of injector nozzle 1 according to the present invention as a function of the opening stroke of valve closure element 14 is advantageous in the case of fuel injector nozzles 1 or fuel injection valves which inject directly into the combustion chamber of the internal combustion engine. When the opening stroke of fuel injector nozzle 1 is short, internal combustion engine piston associated with it is located at a relatively long distance from its top dead center point, and thus at a relatively long distance from fuel injector nozzle 1. It is thus advantageous if, in this operating state, the fuel stream is sprayed out with a relatively large axial component toward the combustion chamber recess. As fuel injector nozzle 1 continues to open, the associated piston of the internal combustion engine, and thus the combustion chamber recess, move toward the top dead center point. In this operating state, it is therefore advantageous if the fuel stream is sprayed out in relatively flat fashion toward the combustion chamber recess which has now moved closer.

The present invention is not limited to the exemplary embodiments described above. The exemplary embodiments can, for example, certainly be combined with one another; for example, a surface structuring of impact surface 19 can also be utilized in an exemplary embodiment having a radially or tangentially inclined impact surface 19. Moreover, the development according to the present invention that is depicted and described can also be used in fuel injection valves for direct injection of fuel into the combustion chamber of an internal combustion engine, in particular in direct gasoline injection valves.

What is claimed is:

1. A fuel injection device, comprising:

a valve closure element having a valve closure surface;

a nozzle body extending along a longitudinal axis and having a valve seat surface, the valve seat surface cooperating with the valve closure surface to form a valve seat, wherein at least one fuel stream is sprayed out from the nozzle body when the fuel injection device is in an open position, the at least one fuel stream having a radial directional component with respect to the longitudinal axis of the nozzle body; and a sleeve body at least partially enclosing the nozzle body, the sleeve body axially overlapping the sprayed—out at least one fuel stream in a direction of the longitudinal axis, the sleeve body having at least one impact surface, wherein the at least one impact surface at least one of has a fluted form and is inclined at a predefined angle with respect to a vertical plane which extends vertically with respect to the longitudinal axis, and wherein the at least one fuel stream strikes the at least one impact surface.

2. The fuel injection device according to claim 1, wherein the at least one impact surface of the sleeve body is inclined with respect to the vertical plane at a particular angle, the particular angle being between 0° and 45°.

3. The fuel injection device according to claim 2, wherein the particular angle is between 5° and 30°.

4. The fuel injection device according to claim 1, wherein the sleeve body annularly encloses a spray-discharge end section of the nozzle body.

5. The fuel injection device according to claim 1, wherein the sleeve body is composed of a stainless steel material.

6. The fuel injection device according to claim 1, wherein the at least one impact surface is inclined in a radial direction with respect to the vertical plane of the longitudinal axis.

7. The fuel injection device according to claim 1, wherein the at least one fuel stream includes a plurality of fuel streams, and wherein the sleeve body has a spray-discharge end and is subdivided at the spray-discharge end into a plurality of sectors which are spaced apart by recesses, each of the sectors having a single respective impact surface which is struck by at least one of the fuel streams sprayed out in different spray directions.

8. The fuel injection device according to claim 7, wherein one of the sectors is associated with a respective radial bore of the nozzle body.

9. The fuel injection device according to claim 7, wherein each of the single respective impact surfaces of the sectors is inclined in a tangential direction with respect to the vertical plane of the longitudinal axis.

10. The fuel injection device according to claim 1, wherein the at least one impact surface has a fluted form and extends in a radial direction.

11. The fuel injection device according to claim 1, further comprising:

a valve needle joined to the valve closure body, wherein the nozzle body has an axial through bore, wherein one of the valve closure body and the valve needle is axially guided in the axial through bore, and wherein the valve closure body closes the axial through bore from an external environment.

12. The fuel injection device according to claim 11, wherein the sleeve body projects beyond a spray-discharge end of the nozzle body, the spray-discharge end extends along an axial longitudinal distance which defines the valve seat surface, and wherein the axial longitudinal distance smaller is than a distance of a predetermined maximum opening stroke of the valve closure element.

13. The fuel injection device according to claim 12, wherein the nozzle body and the sleeve body form a gap in a spray-discharge end region to provide a thermal insulation.

14. The fuel injection device according to claim 1, wherein the fuel injection device includes one of a fuel injection valve and a fuel injector nozzle.

15. A fuel injection device, comprising:

a valve closure element having a valve closure surface;

a nozzle body extending along a longitudinal axis and having a valve seat surface, the valve seat surface cooperating with the valve closure surface to form a valve seat, wherein at least one fuel stream is sprayed out from the nozzle body when the fuel injection device is in an open position, the at least one fuel stream having a radial directional component with respect to the longitudinal axis of the nozzle body; and a sleeve body axially overlapping the sprayed—out at least one fuel stream in a direction of the longitudinal axis, the sleeve body having at least one impact surface, wherein the at least one impact surface at least one of has a fluted form and is inclined at a predefined angle with respect to a vertical plane which extends vertically with respect to the longitudinal axis, wherein the at least one fuel stream strikes the at least one impact surface;

wherein the at least one impact surface of the sleeve body has a radially external end and at least partially circumferential detachment edge on the radially external end, and wherein, using a contour of the sleeve body, the at least partially circumferential detachment edge is undercut by at least partially circumferential groove in the sleeve body to form an acute edge angle at the at least partially circumferential detachment edge.

16. The fuel injection device according to claim 15, further comprising:

at least one ignition electrode extending axially into the at least partially circumferential groove of the sleeve body, wherein the at least one ignition electrode is disposed on an outer periphery of the sleeve body.

17. The fuel injection device according to claim 16, wherein the sleeve body is composed of a ceramic insulating material, and wherein the at least one ignition electrode is electrically insulated from the nozzle body.

18. A fuel injection device, comprising:

a valve closure element having a valve closure surface;

a nozzle body extending along a longitudinal axis and having a valve seat surface, the valve seat surface cooperating with the valve closure surface to form a valve seat, wherein at least one fuel stream is sprayed out from the nozzle body when the fuel injection device is in an open position, the at least one fuel stream having a radial directional component with respect to the longitudinal axis of the nozzle body; and a sleeve body axially overlapping the sprayed—out at least one fuel stream in a direction of the longitudinal axis, the sleeve body having at least one impact surface, wherein the at least one impact surface at least one of has a fluted form and is inclined at a predefined angle with respect to a vertical plane which extends vertically with respect to the longitudinal axis, wherein the at least one fuel stream strikes the at least one impact surface;

wherein the nozzle body has an axial blind bore, the valve closure element being axially movable in the axial blind bore, and wherein the nozzle body has a plurality of radial bores arranged in a circumferentially distributed manner, the radial bores extend through the nozzle body and open into the axial blind bore one of:

at the valve seat surface, and downstream from the valve seat surface.

19. The fuel injection device according to claim 18, wherein the sleeve body has a spray-discharge end and is subdivided at the spray-discharge end into a plurality of sectors which are spaced apart by recesses, and wherein one of the sectors is associated with a respective bore of the radial bores of the nozzle body.

* * * * *